United States Patent [19]

Espeut et al.

[11] Patent Number: 5,012,862

[45] Date of Patent: May 7, 1991

[54] HYDROPHILIC FINS FOR A HEAT EXCHANGER

[75] Inventors: Kenneth W. Espeut, Tampa; Leon Barry, St. Petersburg, both of Fla.

[73] Assignee: JW Aluminum Company, Mt. Holly, S.C.

[21] Appl. No.: 581,356

[22] Filed: Sep. 12, 1990

[51] Int. Cl.[5] ..... F28F 13/18

[52] U.S. Cl. ..... 165/133; 428/457

[58] Field of Search ..... 165/133; 428/457

[56] References Cited

U.S. PATENT DOCUMENTS

| | | | |
|---|---|---|---|
| 3,929,741 | 12/1975 | Laskey | 260/79.3 |
| 4,161,566 | 7/1979 | Higgins | 428/454 |
| 4,181,773 | 1/1980 | Rickert, Jr. | 428/329 |
| 4,540,510 | 9/1985 | Karl | 252/315.3 |
| 4,588,025 | 5/1986 | Imai et al. | 165/133 |
| 4,637,418 | 1/1987 | Karl | 137/13 |
| 4,655,943 | 4/1987 | Elmquist et al. | 252/8.551 |
| 4,664,182 | 5/1987 | Miwa | 165/133 |
| 4,726,886 | 2/1988 | Kaneko et al. | 204/37.6 |
| 4,806,161 | 2/1989 | Fabiny et al. | 106/14.12 |
| 4,830,101 | 5/1989 | Ohara et al. | 165/133 |

FOREIGN PATENT DOCUMENTS

| | | | |
|---|---|---|---|
| 82643/87 | 12/1987 | Australia . | |
| 54-15556 | 2/1979 | Japan | 165/133 |
| 61-185570 | 8/1986 | Japan | 165/133 |
| 61-195290 | 8/1986 | Japan | 165/133 |
| 61-296083 | 12/1986 | Japan | 165/133 |
| 62-80494 | 4/1987 | Japan | 165/133 |
| 63-233300 | 9/1988 | Japan | 165/133 |

*Primary Examiner*—Allen J. Flanigan

*Attorney, Agent, or Firm*—James W. Grace

[57] ABSTRACT

A coating of a polysulphonic acid is applied to a fin of an aluminum heat exchanger to render the surface hydrophilic.

5 Claims, No Drawings

HYDROPHILIC FINS FOR A HEAT EXCHANGER

BACKGROUND OF THE INVENTION

This invention relates to fins for a heat exchanger which have been treated to be hydrophilic.

Heat exchangers of various types have been used in a wide range of applications including room air conditioners, car air conditioners and air conditioners incorporating space coolers and heaters, for example. These heat exchangers are made preponderantly of aluminum and aluminum alloys They generally comprise a zigzagging tube for carrying a coolant, refrigerant or the like and a multiplicity of fins disposed substantially in parallel to one another around the tube.

To reduce the size and improve performance, the designs for heat exchangers of this class of late have employed increasing numbers of fins and, therefore, have had an ever increasing available area of contact between the incoming air and the fins. For the same reasons, the space separating the fins is being reduced to the greatest extent possible without increasing the resistance to air flow between the fins.

When the surface temperature of the fins and the coolant tube falls below the dew point while the cooler is in operation, dew adheres to the surfaces of the fins and coolant tube. The dew adhering to the fins collects into hemispheres or spheres, which may grow until they reach the adjacent fins. When the dew reaches to the adjacent fins in this fashion, it can continue to collect by capillary action, clogging the spaces between the fins. This phenomenon is called bridging.

When the dew induces this bridging phenomenon, the resistance offered by the fins to the passing current of air increases notably, the heat-exchange ratio consequently is lowered and the cooling capacity of the heat exchanger degraded. These fins, therefore, should possess a hydrophilic surface.

The methods proposed to date for imparting a hydrophilic surface to the fins include forming thereon a coating containing a surfactant such as polyoxyethylene nonylphenyl ether on the surfaces of the fins, coating the surfaces of the fins with colloidal silica or water glass, and subjecting the surfaces of the fins to a post boehmite-treatment, for example.

Another hydrophilic coating comprises a proteinaceous substance having a peptide bond, i.e., gelatin. Further enhancement of the fins affinity for water is obtained by using a hydrophilic coat prepared by mixing a water soluble coating material such as acrylic paint, with the proteinaceous substance.

Other methods for coating fins may involve a phosphate treated aluminum surface which is processed directly with an aqueous silicate coating and then dried.

A still further method is coating an aluminum fin with an organic resin film having corrosion resistance over which a hydrophilic coating consisting of silicates such as silica sol, silicic acid and water glass is formed.

SUMMARY OF THE INVENTION

An object of this invention is to provide fins for a heat exchanger which have a high affinity for water and therefore inhibit the aforementioned bridging phenomenon due to dew.

Another object of this invention is to provide fins which are highly machinable during fabrication (by pressing, punching, etc.).

These objectives are accomplished according to the present invention by providing a fin having a hydrophilic coat containing a specific substance on the surfaces of fin substrates, preferably made of aluminum or an aluminum alloy. To be specific, the fins of a heat exchanger according to the present invention have formed on their surfaces a hydrophilic coat comprising a polysulfonic acid coating, of which poly(2 acrylamide-2 methyl propanesulfonic acid, available as Rheothik 80-11 from Henkel Corporation is an example.

The other objects and characteristic features of the present invention will become apparent to those skilled in the art from the following description of a preferred embodiment of the invention.

DETAILED DESCRIPTION OF THE INVENTION

The fin itself is preferably of thin aluminum stock (about 0.1 to 0.3 mm in thickness). After a well-known cleaning process, the fin is coated with an aqueous coating of a polysulfonic acid which is left to dry. If desired, a small amount of dimethyl-amino-ethanol may be added to the polysulfonic acid.

The preferred formula for the hydrophilic coating of the invention is:

| | Preferred P.b.w. | Range P.b.w. |
|---|---|---|
| polysulfonic acid | 9.5 | 8.5–10.5 |
| water | 89.7 | 90.7–88.7 |
| dimethyl-amino-ethanol | 0.8 | 0.7–0.9 |
| | 100.0 P.b.w. | |

The preferred polysulfonic acid is Rheothik 80-11 sold by Henkel Corporation of Minneapolis, Minnesota. The polysulfonic acid is 2-acrylamido-2 methyl propane sulfonic acid. The polysulfonic acid has the structural formula:

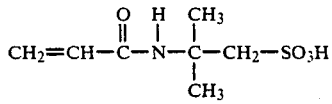

The polymerization of this monomer is described in U.S. Pat. No. 4,637,418 issued on Jan. 20, 1987 and assigned to the Henkel Corporation. This description of the polymerization of the monomer is incorporated by reference into this disclosure.

In the present invention the polymer has a molecular weight of about 1,000,000.

The function of the dimethyl-amino-ethanol is to adjust the pH to a neutral pH of about 7.

In order to show the effectiveness of the polysulfonic acid coating, a series of contact angle tests were made to determine affinity for water. In the contact angle test, a drop of distilled water was placed on each test piece with a pipette and the contact angle of the drop was observed under a microscope.

The pieces of fin stock used in the tests were about 0.005 inches in thickness and squares of 3"×3" in area. The surface of one side of each piece of fin stock was watered with the preferred formula at a rate of between 0.03–0.05 pounds per 3000 square feet.

The initial contact angle was determined by using a freshly watered but dried sheet of fin stock and by applying a single drop of water from a pipette gently on the surface. The contact angle was measured to be between 15° and 18°.

A cycling test was then performed using three pieces of fin stock which were coated and dried. Each piece of fin stock was immersed in running water for seven hours. The rate of the water was at about 700–1000 ml per minute. After seven hours, the sheets were dried at room temperature (about 24° C.) for about 17 hours.

The contact angle was measured after 20 cycles and found to be about 5°.

A second cycling test was performed under the same conditions as the first cycling test except that the fin was dried in an oven at a temperature of 80° C. The contact angle was measured after 20 cycles and found to be 5°.

Thus, the coating of the aluminum fin stock with an aqueous solution of polysulfonic acid resulted in a wettable fin stock which avoids the problem of bridging while a specific embodiment of the inventions has been described, other variations will occur to those skilled in the art and it is intended to cover this embodiment and other variations in the accompanying claims.

We claim:

1. An aluminum fin stock comprising a thin sheet of aluminum, said sheet having one or more sides coated with an aqueous solution of a polysulfonic acid, said solution being subsequently dried.

2. An aluminum fin stock as recited in claim 1 in which said aqueous solution of a polysulfonic acid also includes a pH adjusting chemical.

3. An aluminum fin stock as recited in claim 2 in which said aqueous solution of a polysulfonic acid is applied at an amount of between 0.03 and 0.05 pounds per 3000 square feet.

4. An aluminum fin stock as recited in claim 1 in which said aqueous solution of a polysulfonic acid comprises between 8.5 and 10.5 parts by weight of polysulfonic acid, between 90.7 and 88.7 parts by weight of water and between 0.7 and 0.9 parts by weight of dimethyl-amino-ethanol.

5. An aluminum fin stock as recited in claim 1 in which said polysulfonic acid is 2-acrylamido-2 methyl propane sulfonic acid.

* * * * *